US005299793A

United States Patent [19]

Couturier

[11] Patent Number: 5,299,793

[45] Date of Patent: Apr. 5, 1994

[54] MULTI-PANEL REFOLDING TRANSFER SYSTEM WITH ROTATING TRANSFER CLAMP

[75] Inventor: Dennis P. Couturier, Washburn, Wis.

[73] Assignee: C. G. Bretting Manufacturing Company, Inc., Ashland, Wis.

[21] Appl. No.: 980,493

[22] Filed: Nov. 23, 1992

[51] Int. Cl.[5] ..... B41L 1/32; B31B 1/00

[52] U.S. Cl. ..... 270/39; 493/409; 493/450

[58] Field of Search ..... 270/39, 40, 49, 50, 270/51; 493/409, 411, 412, 413, 453; 53/540, 447

[56] References Cited

U.S. PATENT DOCUMENTS 4,700,939 10/1987 Hathaway ..... 493/412 X
4,717,135 1/1988 Hathaway ..... 270/39
4,721,295 1/1988 Hathaway ..... 493/412 X
4,751,807 6/1988 Couturier .
4,770,402 9/1988 Couturier ..... 270/39
4,874,158 10/1989 Retzloff ..... 270/39
5,088,707 2/1992 Stemmler ..... 270/39

*Primary Examiner*—Edward K. Look
*Assistant Examiner*—John Ryznic
*Attorney, Agent, or Firm*—Faegre & Benson

[57] ABSTRACT

An apparatus and method for transferring a clip formed of a predetermined number of interfolded paper products away from a stacking interfolder and refolding a plurality of loose end panels having a stack building table and first count finger assembly initially holding the clip and transferring control of the clip to a transfer clamp which refolds a first loose end panel and further having a clip destination station having a post end panels receiving the clip and finally refolding the final loose end panel.

20 Claims, 6 Drawing Sheets

MULTI-PANEL REFOLDING TRANSFER SYSTEM WITH ROTATING TRANSFER CLAMP

BACKGROUND OF THE INVENTION

This invention relates to the field of automatic interfolding machines which interfold a stack of laminar products such as paper towels, paper tissues, and the like. In such machines, it is known to interfold adjacent products with more than one panel of adjacent products or sheets interfolded. In addition, it is also known to separate a clip or log of a predetermined number of such products from the continuously building interfolding stack. An example of an automatic separator is shown in U.S. Pat. No. 4,770,402. The separator shown in U.S. Pat. No. 4,770,402 separates products where only one panel is interfolded between adjacent products. However, it has been found that this apparatus is also capable of separating products with more than one panel interfolded. Products such as this are known in the industry as "W" folds. When interfolded products are produced by such equipment there are sheets remaining free after separation of the clip from the stack, and it is desirable to refold the loose sheets or panels to provide the highest quality product. Refolding the loose sheets on the bottom of the continuously building stack may be accomplished by the invention shown in U.S. Pat. No. 4,874,158. However, interfolded products with more than one panel interfolded will have multiple loose panels on the separated clip as well and it is desirable to refold those loose panels as well as the loose panels associated with the continuously building stack.

The present invention relates to refolding the loose panels on the separated clip or log.

DETAILED DESCRIPTION

Figure 1:
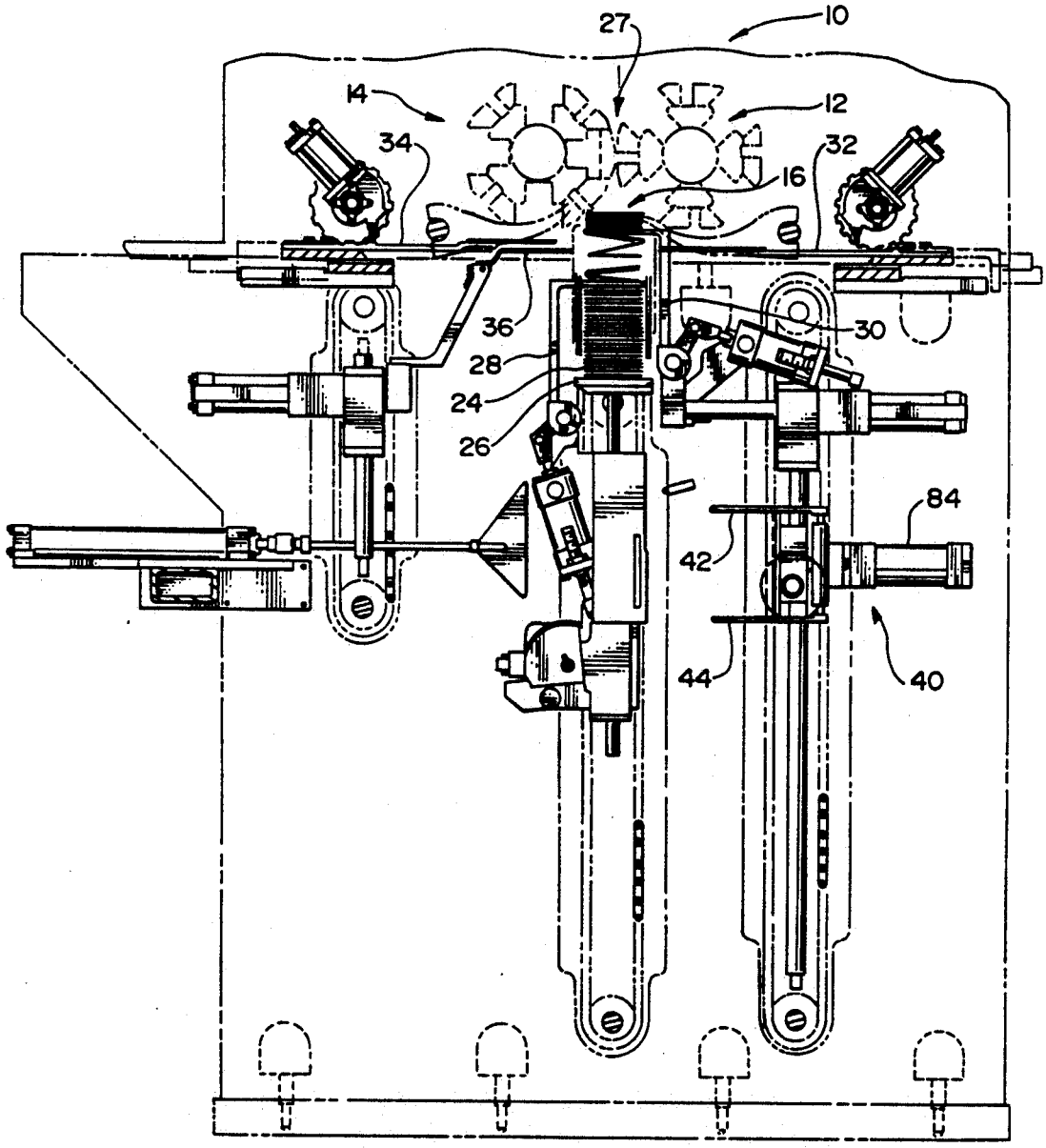
FIG. 1 is a simplified side elevation view of a machine which continuously interfolds products into a "W" interfolded stack.
Figure 2:
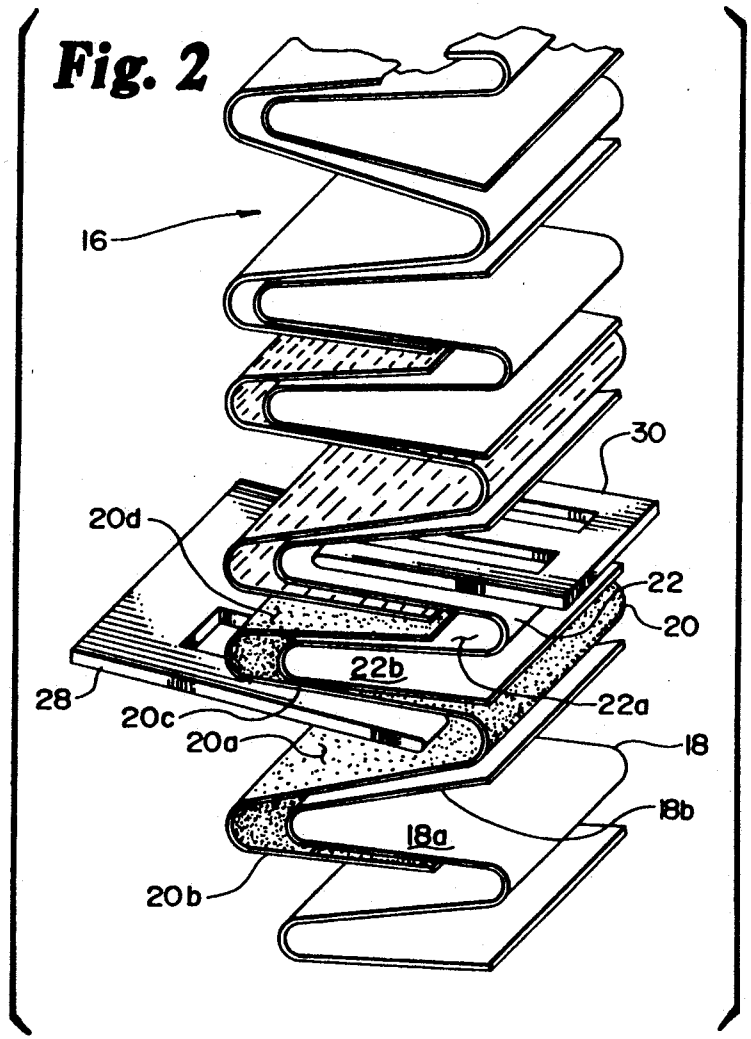
FIG. 2 is a simplified view of a continuously building stack of interfolded "W" products immediately before separation of a clip from the stack with the product folds expanded.
Figure 5:
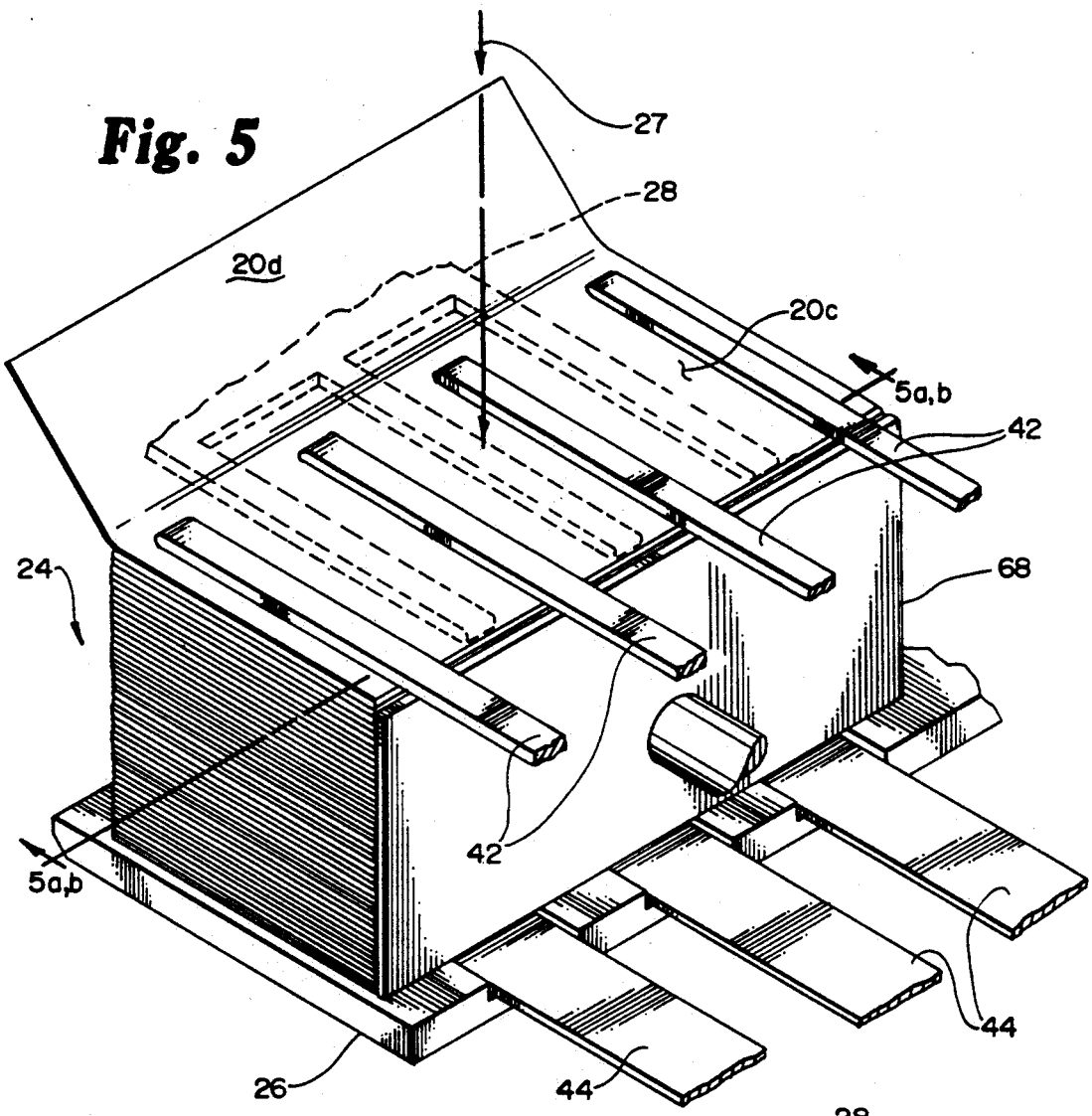
FIGS. 5, 5*a*, and 5*b* are a perspective close-up view of a clip showing certain aspects of the present invention.

Referring now to the Figures, and most particularly to FIG. 1, a "W" interfolding machine 10 may be seen. Machine 10 has a pair of interfolding rolls 12, 14 shown in phantom which continuously build a stack 16 of "W" interfolded products. Referring now also to FIG. 2, an expanded view of the "W" interfolded product stack may be seen. In the continuously building stack 16, a first product 18 is interfolded with a second product 20 such that end panels 18*a*, *b* and 20*a*, *b* are arranged in an overlapping or nesting relationship. Similarly, a third product 22 has a pair of end panels 22*a*, *b* interfolded or nested with end panels 20*c*, *d* of product 20. Even though the panels are shown spaced apart in FIG. 2, it is to be understood that the stack and resulting clips formed from the stack preferably have adjacent panels relatively closely spaced together as shown in FIGS. 1 and 5. FIG. 1 shows a completed clip 24 of products supported by a stack building table 26. It is to be understood that stack 16 and clip 24 define a stack building path 27 along which interfolding rolls 12, 14 build the stack 16 of continuously interfolded products 18 et seq. FIG. 1 shows a condition immediately subsequent to insertion of a first count finger assembly 28 and a second count finger assembly 30 resulting in separation of clip 24 from stack 16.

FIG. 2 is a simplified view of stack 16 immediately prior to separation of a clip of interfolded "W" products 18 et seq. wherein the first count fingers 28 and the second count fingers 30 have been inserted into the appropriate folds between respective panels during the stack building process. At this point, stack 16 is supported by the second count fingers 30 (see FIG. 1) and a clip of a predetermined number of paper products is trapped below first count fingers 28 which is subsequently separated from the stack as shown in FIGS. 1 and 3.

Figure 3:
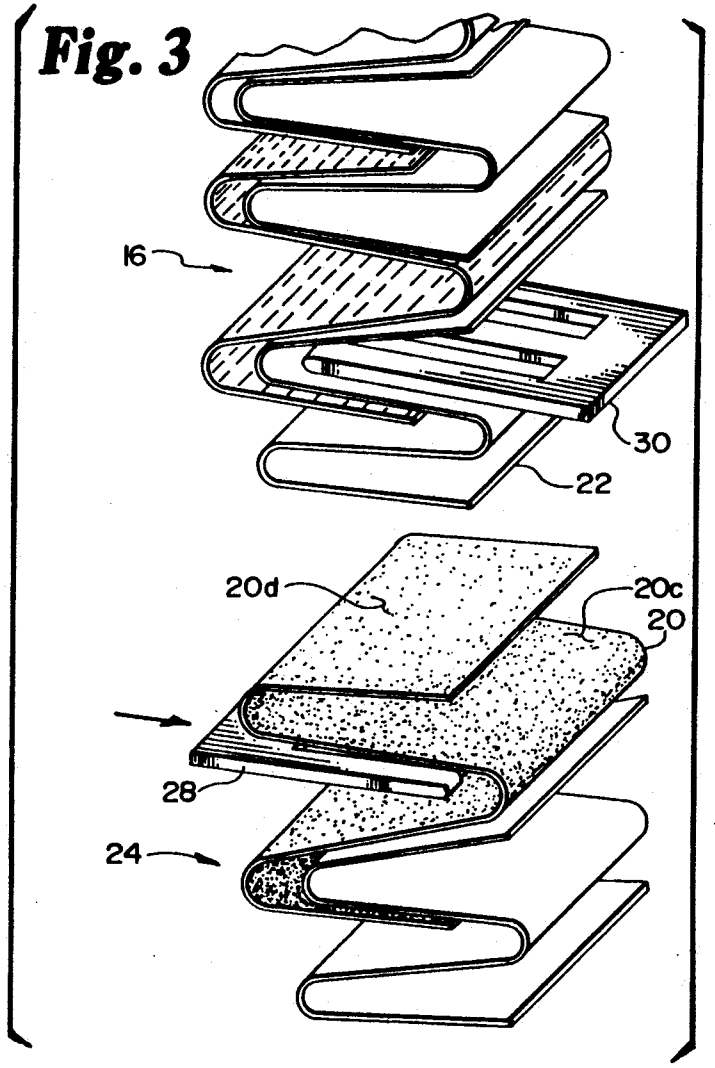
FIG. 3 is a simplified view similar to FIG. 2 immediately after separation of the clip from the stack with the product folds expanded.

FIG. 3 illustrates an expanded view of the position of stack 16 and clip 24 in the portion of a clip separating cycle shown in FIG. 1. Loose end panels of product 22 may be refolded into the bottom of the stack 16 by front and rear fold over assemblies 32, 34 and by a package building finger assembly 36 in a manner substantially the same as that disclosed in U.S. Pat. No. 4,874,158 and hence not discussed further here. As may be seen most clearly in FIGS. 1 and 3, to accomplish separation, first count fingers 28 capture a clip 24 between fingers 28 and table 26 However, a proximal end panel 20*c* and a distal end panel 20*d* remain loose from the clip 24 and are desirably refolded to maintain product quality of the clip 24 of "W" interfolded products.

Figure 4:
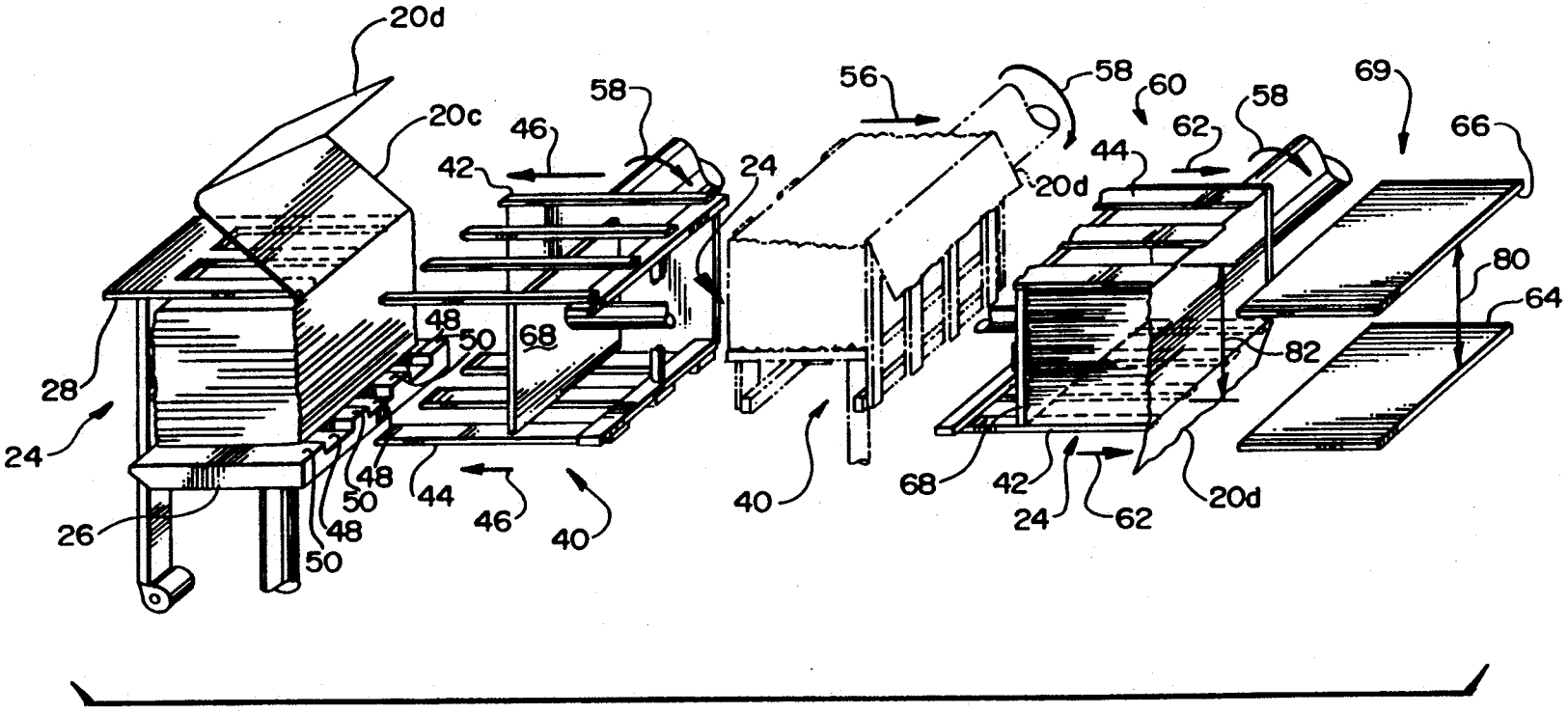
FIG. 4 is a simplified view of the certain apparatus of the present invention showing the transfer clamp in various positions in a transfer and refolding cycle.

Referring now to FIG. 4, a free-body diagram of a transfer clamp apparatus 40 useful for accomplishing refolding of loose end panels 20*c*, 20*d* may be seen.

Figure 6:
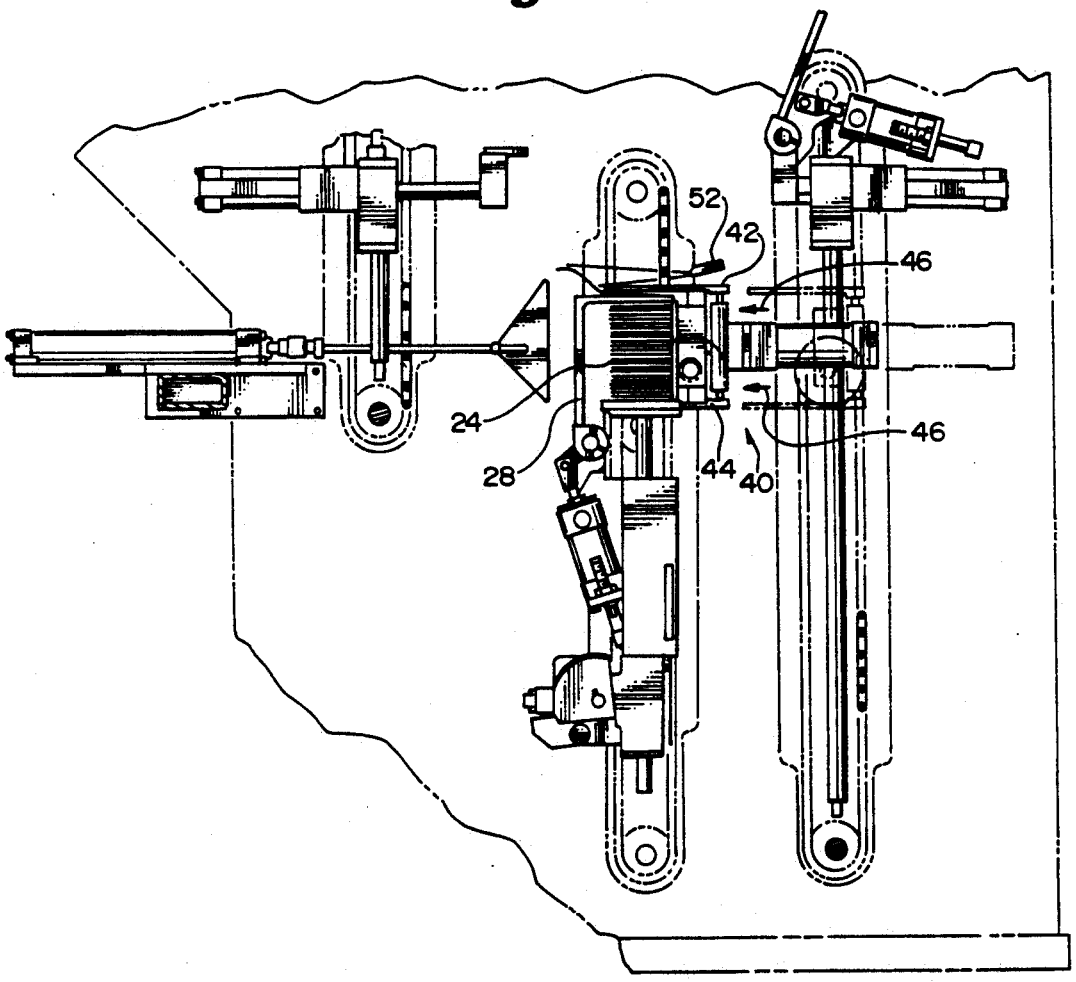
FIG. 6 is a partial view similar to FIG. 1 showing the apparatus of the present invention at a beginning of a loose panel refolding cycle.

In FIG. 4, clip 24 is retained initially between table 26 and first count finger assembly 28. At this time a pair of loose end panels 20*c*, 20*d*, extend from the product at the end of clip 24. Referring now also to FIG. 6, to initiate a clip transfer and panel refolding transfer cycle, transfer clamp 40 moves from the position shown in phantom lines to the position shown in solid lines. Clamp 40 has a set of first clamping fingers 42 longitudinally spaced apart from a set of second clamping fingers 44. Clamp 40 is moved transversely toward clip 24 in the direction of arrow 46 such that second clamping fingers 44 are received below clip 24 in respective recesses 48 of table 26. Recesses 48 are interdigitated with a plurality of lands 50 to support clip 24 on table 26. As clamp 40 is extended transversely towards clip 24, an air pressure source 52 (see FIG. 6) directs toward loose end panels 20*c* urge panel 20*c* against an outer surface of first count finger assembly 28 to prevent trapping panel 20*d* below first clamping fingers and to prevent tearing product 20.

Figure 5A:
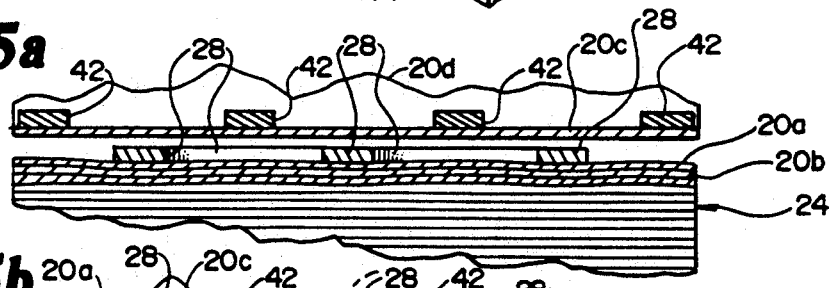
Figure 5B:
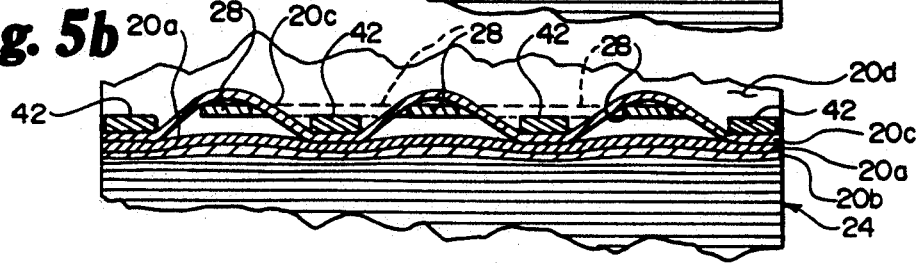
Figure 7:
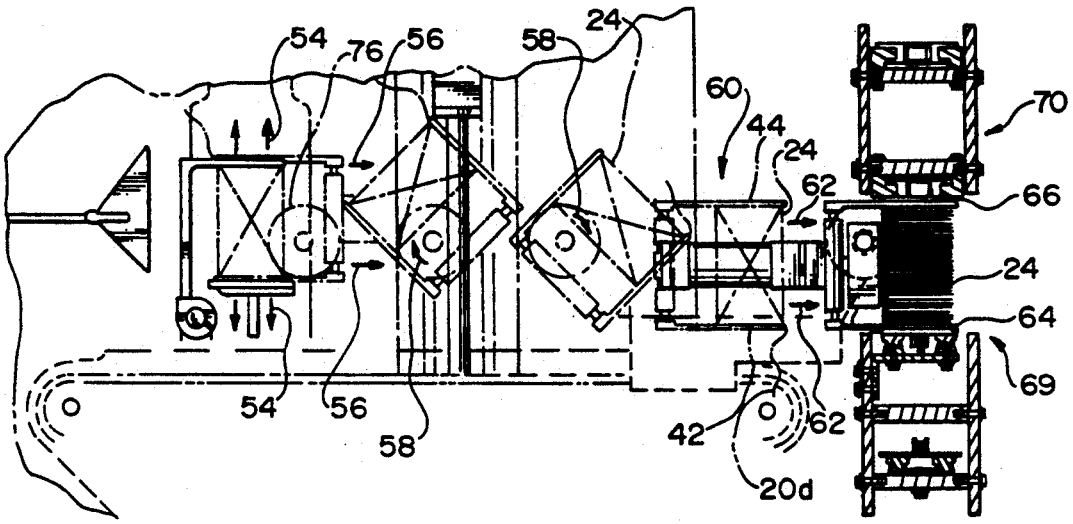
FIG. 7 is a partial view similar to FIG. 6 of the apparatus of the present invention showing a side view of the transfer clamp in various positions during the process of loose panel refolding similar to FIG. 4.

Referring now also to FIGS. 5, 5*a* and 5*b*, it is to be understood that as clip 24 separated from stack 16, first count finger assembly 28 and table 26 hold clip 24 in compression to retain control of clip 24 as shown in FIG. 5*a*. Once the transfer clamp 40 moves transversely to the position shown in solid lines in FIG. 6, the table 26 and first count finger assembly 28 are moved apart thus transferring control of clip 24 to transfer clamp 40 as indicated in FIG. 5*b*. This action is indicated by arrows 54 in FIG. 7. Clamp 40 carrying clip 24 is moved transversely in the direction of arrows 56 (see FIG. 4) and then rotated in the direction of arrow 58 inverting the clip 24 such that loose end panel 20*d* is at the bottom of the clip 24 as shown in position 60 in FIGS. 4 and 7. Clamp 40 is then extended in the direction of arrows 62 (see FIG. 4) inserting clip 24 between end plates 64, 66. It is to be understood that end plates 64, 66 are preferably positioned apart a distance 80 slightly greater than a distance 82 spanned the first and second clamping fingers 42, 44. Clip 24 is then held between plates 64, 66 by a pusher plate 68 as the first and second clamping finger assemblies 42, 44 retract from between end plates 64, 66, thus leaving clip 24 between end plates 64, 66 in a conveyor 70 which subsequently indexes to move clip 24 away and position a new pair of empty end plates (not shown) to receive a subsequent clip.

Figure 8:
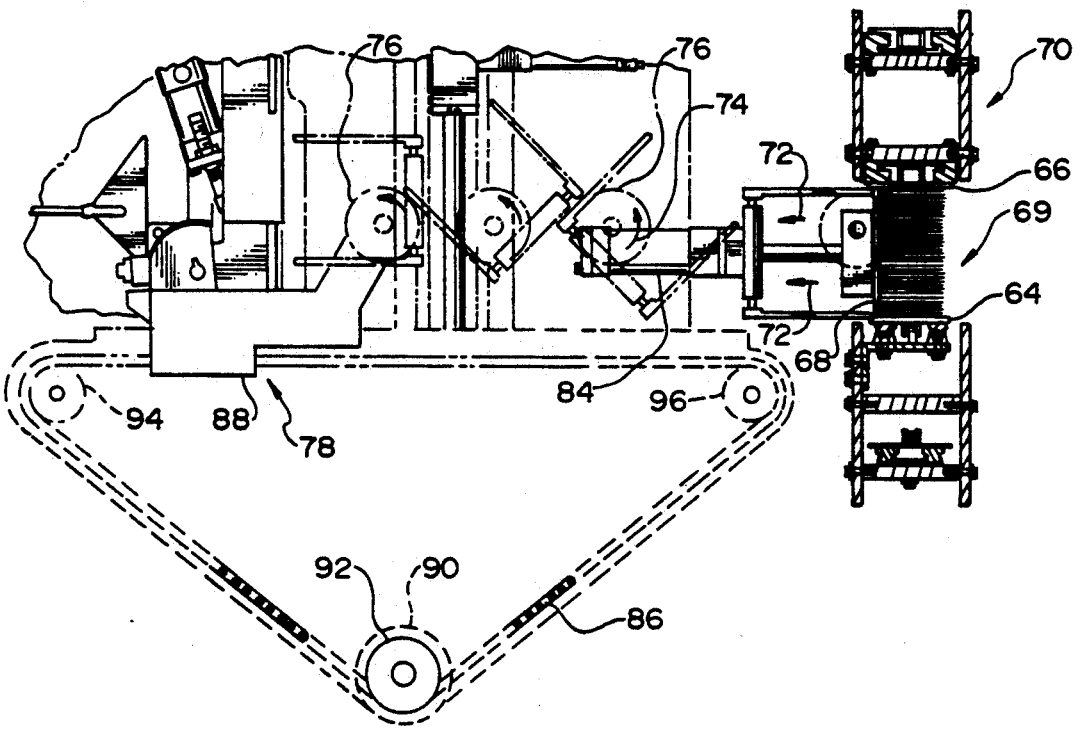
FIG. 8 is a partial view similar to FIG. 7 showing the transfer clamp apparatus returning to a position ready to begin a new loose panel refolding cycle.

Referring now to FIG. 8, transfer clamp 40 is retracted in a direction of arrows 72 after discharging the clip 24 at a discharge station or destination 69 to conveyor 70. The clamp 40 is then rotated in the direction of arrow 74 (as shown in FIG. 8) to prepare clamp 40 for another transfer and refolding cycle. It is to be understood that alternative equipment may replace conveyor 70, for example, a carton infeed apparatus (not shown).

It is to be understood that machine 10 further includes clamp displacement means such as a rotary motor 76 to rotate clamp 40 and a servomotor and chain drive assembly 78 to enable moving the transfer clamp in and out of the stack building path, to traverse to the discharge station 69 and to move the clamp 40 in and out from between the end plates 64, 66 while at the discharge station. Assembly 78 is preferably made up of an endless chain 86 driving a carriage 88 secured thereto, both of which are driven by a servomotor 90 through a sprocket 92. Carriage 88 is positionable at any desired position between a pair of idler sprockets 94,96 on which chain 86 is carried. An air cylinder 84 is preferably used to provide relative motion between pusher plate 68 and clamping fingers 42,44.

Thus it may be seen that in the practice of the present invention, two loose end panels are refolded into the clip. The proximal loose end panel 20*c* resulting from separation of clip 24 from stack 16 is refolded by transferring the clip to the transfer clamp 40 from between the first count fingers 28 and elevator table 26. The distal loose end panel 20*d* is subsequently refolded into the clip by the insertion of clip 24 into subsequent machinery having opposing end plates 64, 66 such that end panel 20*d* is refolded into the clip when the first clamping fingers 42 are withdrawn from between clip 24 and end plate 66.

Referring now again more particularly to FIGS. 5*a* and 5*b*, certain aspects of the refolding the present invention may be seen. In FIG. 5*a*, clip 24 is controlled or held by the first count finger assembly 28. After the first clamping fingers 42 move transversely to project above clip 24 in the stack building path, loose panel 20*c* is trapped between fingers 28 and 42. The table 26 and first count fingers 28 are moved apart in a direction of the stack building path such that the products making up clip 24 are allowed to expand against first clamping fingers 42 as shown in FIG. 5*b*. At this time, panel 20*c* is arranged in a slightly corrugated fashion between fingers 28 and 42 as may be seen most clearly in FIG. 5*b*. Subsequently clip 24 is withdrawn transverse to the stack building path 27, thus disengaging fingers 28 from between panels 20*a* and 20*c*.

Referring now most particularly to FIGS. 5, 5*a* and 5*b*, it may be seen that the first clamping fingers 42 are located above the first count fingers 28 initially and that at least one of the first count fingers is positioned intermediate a pair of the first clamping fingers when the transfer clamp 40 is in the stack building path 27 such that a proximal one of the loose end panels (20*c*) is trapped between the first clamping fingers 42 and the first count fingers 28. The air pressure source 52 provides an air assist means for directing air generally transversely across the first count fingers 28 such that the plurality of loose end panels 20*c*, 20*d* are urged in a direction away from the transfer clamp 40.

The movement shown by FIGS. 5*a* and 5*b* is such that the first count fingers 28 are moved toward the first clamping fingers 42 a distance large enough to transfer control of the clip 24 to the pair of first clamping fingers and small enough to avoid permanent deformation of the proximal one loose end panel 20*c* when the stack building table 26 and the first count fingers 28 are moved away from the clip 24. The first count fingers 28 are preferably spaced transversely apart from respective adjacent first clamping fingers 42 by a lateral distance sufficient to permit retention of clip 24 by the transfer clamp 40 without permanent deformation of panel 20*c* when it is trapped between first count fingers 28 and first clamping fingers 42 as shown in FIG. 5*b*.

The invention is not to be taken as limited to all of the details thereof as modifications and variations thereof may be made without departing from the spirit or scope of the invention.

What is claimed is:

1. A method of refolding adjoining proximal and distal loose end panels extending from a clip of paper products interfolded in a plurality of parallel planes and initially held between a pair of first opposing surfaces, the method comprising the steps of:

a) urging the loose end panel proximal the clip towards a plane parallel to the planes of the interfolded products;

b) trapping the proximal loose end panel by moving a clamping finger adjacent the proximal loose end panel and exterior of the clip;

c) moving the clip away from the pair of first opposing surfaces;

d) trapping the distal loose end panel by moving the clip and the clamping finger past one of a pair of second opposing surfaces; and e) retracting the clamping finger from between the distal loose end panel and the clip such that the proximal and distal loose end panels are refolded into the clip and the clip is subsequently held between the pair of second opposing surfaces.

2. The method of claim 1 wherein step a) further comprises blowing air against the proximal loose end panel to urge it towards the plane parallel to the planes of the interfolded products.

3. Apparatus for transferring a clip formed of a predetermined number of interfolded paper products away from a stacking interfolder and refolding a plurality of loose end panels of the clip comprising:

a) a stack building table positioned to receive a continuously building interfolded stack of paper products in a longitudinally oriented stack building path wherein adjacent products have a plurality of end panels interfolded in an overlapping relationship;

b) a first count finger assembly selectively positionable into the stack building path to separate a clip of a predetermined number of interfolded paper products from the stack while allowing a plurality of loose end panels to extend away from one end of the clip exteriorly of the first count finger assembly;

c) a transfer clamp located adjacent the stack building path, the transfer clamp having first and second longitudinally spaced apart clamping fingers projecting transversely towards and reciprocally movable transversely into and out of the stack building path such that the clip is retained by the first and second clamping fingers when the transfer clamp is moved transversely into the stack building path and the stack building table is retracted away from the first count fingers;

d) clamp displacement means for moving the transfer clamp out of the stack building path and for rotating the transfer clamp such that the clamping fingers are positioned to project away from the stack building path; and e) a clip destination station located away from the stack building path and having first and second opposed end plates positioned apart a distance slightly greater than the distance between the first and second clamping fingers for receiving the clip from the transfer clamp and for retaining the clip as the clamp moves away from the clip destination station wherein the loose end panels are refolded into the clip by the first clamping finger moving transversely adjacently past:

i) the first count finger prior to rotation of the transfer clamp, and ii) the first end plate subsequent to rotation of the transfer clamp.

4. The apparatus of claim 3 wherein stack building table comprises a plurality of transversely extending lands and recesses.

5. The apparatus of claim 4 wherein the second clamping fingers extend into the recesses between the lands of the stack building table when the transfer clamp is moved into the stack building path.

6. The apparatus of claim 5 wherein the first clamping fingers are located above the first count fingers and at least one of the first count fingers is positioned intermediate a pair of the first clamping fingers when the transfer clamp is in the stack building path such that a proximal one of the loose end panels is trapped between the first clamping fingers and the first count fingers.

7. The apparatus of claim 6 further comprising:

f) air assist means for directing air generally transversely across the first count fingers such that the plurality of loose end panels are urged in a direction away from the transfer clamp.

8. The apparatus of claim 6 wherein the clip is retained between the pair of first clamping fingers and the second clamping fingers when the stack building table and the first count fingers are moved away from the clip.

9. The apparatus of claim 8 wherein the first count fingers are moved towards the pair of first clamping fingers a distance:

i.) large enough to transfer control of the clip to the pair of first clamping fingers, and ii.) small enough to avoid permanent deformation of the proximal one loose end panel when the stack building table and the first count fingers are moved away from the clip.

10. The apparatus of claim 8 wherein at least the one first count finger is spaced transversely apart from the pair of first clamping fingers between which it is positioned by a distance sufficient to permit clip retention by the transfer clamp without permanent deformation of the proximal one loose end panel trapped between the first count fingers and the first clamping fingers.

11. The apparatus of claim 3 wherein the transfer clamp further comprises a pusher plate longitudinally intermediate the first and second clamping fingers and positionable with the clamping fingers to move the clip from the stack building path to the clip destination station.

12. The apparatus of claim 8 wherein the first and second clamping fingers are movable independently of the pusher plate such that the pusher plate remains at the clip destination station while the clamping fingers are retracted to leave the clip between the first and second end plates.

13. A method of transferring a clip formed of a predetermined number of interfolded paper products away from a continuously building stack and refolding a pair of loose end panels of the clip comprising the steps of:

a) continuously building an interfolded stack of paper products longitudinally in a stack building path on a stack building table such that adjacent products have a pair of end panels overlapped and interfolded;

b) selectively positioning a first count finger assembly into the stack building path for separating a clip of a predetermined number of the interfolded paper products from the stack such that a proximal end panel and a distal end panel extend loosely away from one end of the clip exteriorly of the first count fingers;

c) positioning a transfer clamp adjacent the stack building path wherein the transfer clamp has first and second longitudinally spaced apart clamping fingers projecting transversely towards the stack building path;

d) refolding the loose proximal end panel towards the clip by moving the first clamp fingers transversely past the first count fingers while moving the transfer clamp transversely into the stack building path to a position wherein the first count fingers are between the clip and the first clamp fingers;

e) moving the stack building table and the first count fingers apart such that the clip is retained by the first and second clamping fingers;

f) moving the transfer clamp out of the stack building path and rotating the transfer clamp such that the clamping fingers are positioned facing away from the stack building path; and g) refolding the loose distal end panel toward the clip by moving the first clamping fingers transversely adjacently past a first end plate of a clip destination station while transferring the clip to the clip destination station.

14. The method of claim 13 wherein the stack building table further comprises a plurality of transversely extending lands and recesses and step d) further comprises extending the second clamp fingers into the recesses of the stack building table.

15. The method of claim 13 wherein step e) further comprises moving the first count fingers toward the first clamping fingers by a distance sufficient to transfer clamping pressure on the clip from the first count fingers to the first clamping fingers but less than a distance sufficient to cause permanent deformation of the proximal end panel.

16. The method of claim 15 wherein the first count fingers and the first clamping fingers are relatively widely transversely spaced apart.

17. The method of claim 13 further comprising the additional step:

h) retracting the first and second clamping fingers transversely away from the clip destination station.

18. The method of claim 17 wherein the transfer clamp further comprises a pusher plate longitudinally intermediate the first and second clamping fingers and wherein step g) further comprises moving the pusher plate along with the clamping fingers towards the clip destination station while transferring the clip to the clip destination station.

19. The method of claim 18 wherein step h) further comprises holding the pusher plate adjacent the clip at the clip destination station while retracting the first and second clamping fingers.

20. The method of claim 13 wherein step d) further comprises blowing air transversely across the first count fingers such that the loose proximal end panel is urged away from the transfer clamp.

* * * * *